US005521141A

United States Patent [19]

Mizobuchi

[11] Patent Number: 5,521,141

[45] Date of Patent: May 28, 1996

[54] DYE-DONOR FILM FOR THERMOSENSITIVE DYE-TRANSFER SYSTEM

[75] Inventor: Yoshikazu Mizobuchi, Des Plaines, Ill.

[73] Assignee: Minnesota Mining and Manufacturing Company, St. Paul, Minn.

[21] Appl. No.: 356,278

[22] PCT Filed: Aug. 6, 1993

[86] PCT No.: PCT/US93/07418

§ 371 Date: Dec. 20, 1994

§ 102(e) Date: Dec. 20, 1994

[87] PCT Pub. No.: WO94/03334

PCT Pub. Date: Feb. 17, 1994

[30] Foreign Application Priority Data

Aug. 6, 1992 [JP] Japan ..... 4-210307

[51] Int. Cl.[6] ..... B41M 5/035; B41M 5/38

[52] U.S. Cl. ..... 503/227; 428/195; 428/318.4; 428/321.3; 428/913; 428/914

[58] Field of Search ..... 8/471; 428/195, 428/318.4, 321.3, 913, 914; 503/227

[56] References Cited

U.S. PATENT DOCUMENTS

| | | | |
|---|---|---|---|
| 4,784,905 | 11/1988 | Suzuki et al. | 428/321.3 |
| 4,847,144 | 7/1989 | Suzuki et al. | 428/321.5 |
| 5,352,651 | 10/1994 | Debe et al. | 503/227 |

FOREIGN PATENT DOCUMENTS

| | | | |
|---|---|---|---|
| 02-215592 | 8/1990 | Japan | 503/227 |

*Primary Examiner*—Bruce Hess

*Attorney, Agent, or Firm*—Gary L. Griswold; Walter N. Kirn; Mark A. Litman

[57] ABSTRACT

A film for producing a dye diffusion transfer image comprising diffusible dyes physically located in pores of a porous film having a Gurley value between 20 and 400 seconds per 50 cubic centimeters of air, said porous film containing no binder.

10 Claims, 21 Drawing Sheets

DYE-DONOR FILM FOR THERMOSENSITIVE DYE-TRANSFER SYSTEM

BACKGROUND OF THE INVENTION

This invention relates to a binder-less porous donor for producing a dye diffusion thermal transfer image.

A dye diffusion thermal transfer system is broadly used because it can produce an image in a completely dry process with a non-impact system using digitalized image information, the produced image having a high continuous gradation. In this system, image formation has hitherto been carried out by bringing a donor layer comprised of dyes and a macromolecular binder fixed on a donor substrate film in contact with a receptor layer on which an image is to be formed, bringing a thermal head into contact with the surface of the donor substrate film opposite the surface on which donor layer is placed, diffusing the dyes in the donor layer onto the receptor layer perpendicularly to the surface of the receptor layer by the thermal energy supplied from the thermal head, and then fixing the dyes thereon. This system is schematically illustrated in FIG. 1.

Such systems are disclosed, for example, in Japanese Unexamined Patent Publication (Kokai) Nos. 3-13386, 3-65394, 3-65395, and 3-86589. In conventional films using binders, a high affinity between the dyes and the binder is required in order to sufficiently diffuse the dyes in the donor layer. If the affinity is high, a high thermal energy is required for diffusing the dyes into the receptor layer. An energy threshold of diffusion of the dyes also exists. Thus, it is difficult to form an image having both a high continuous gradation and a high optical density at a low thermal energy.

SUMMARY OF THE INVENTION

Accordingly, the present invention provides a donor film that allows the dyes to be diffused at a low thermal energy, entails no energy threshold to the thermal diffusion of dyes, and is capable of forming an image having a high continuous gradation even in a wide optical density range.

In accordance with the present invention, a novel donor layer is formed by physically locating diffusible dyes in the pores of a porous film having a pore size between 20 and 400 Gurley. By eliminating the need for a binder, the porous film of the present invention allows the dyes contained therein to be diffused onto the receptor layer at a low thermal energy without entailing any thermal threshold.

Thus, the present invention provides a film for producing a dye diffusion thermal transfer image comprising diffusible dyes physically located in the pores of a porous film having a pore size between 20 and 400 Gurley. Advantageously, the porous film contains no binder.

The present invention further provides a process for the thermal diffusion transfer of a color image, comprising placing a color thermal diffusion dye donor sheet in intimate association with a receptor sheet, and heating said donor sheet in a desired pattern at a sufficient temperature and/or pressure to transfer the dyes from the donor sheet to the receptor sheet. The donor sheet comprises a porous polymeric material having a thermally diffusible dye located within the pores of the said porous material. Advantageously, the donor sheet contains no binder.

DETAILED DESCRIPTION OF THE PREFERRED EMBODIMENTS

Figure 1:
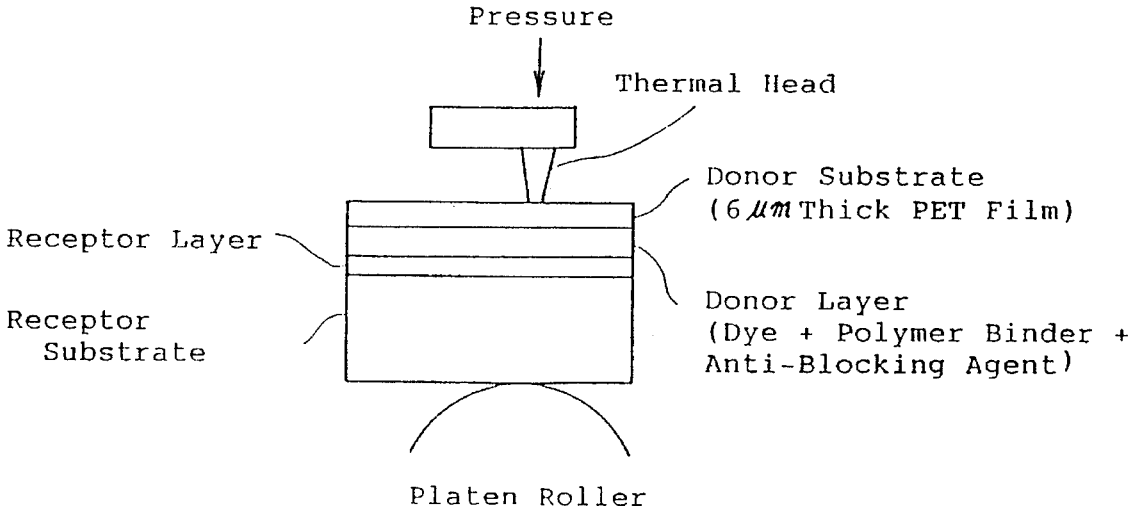
FIG. 1 shows a construction of a general donor film and a comparative image forming system.

The porous films which can be used in this invention include, for example, films made out of polyethylene, polypropylene, polyester, and polycarbonate, and thin paper. The film thickness is in the range of 10 μm to 25 μm, preferably 14 μm to 20 μm. The pore size expressed in a Gurley value is in the range of 20–400. Typical examples of the porous films which can be used are Polyethylene film #06106-5, Polypropylene film 17770-28, Polypropylene film #770-2S, Polypropylene film #770-3S, Polypropylene film #770-4S, Polypropylene film #770-6S, Polypropylene film #739-2B (all produced by 3M Company), and the like.

The pore size of the porous film is between 20 and 400 Gurley. If this value is more than 400, it becomes difficult to introduce dyes into the pores. If this value is less than 20, the resolution of the image is lowered.

In this invention, cyan dyes, magenta dyes, yellow dyes, and any other conventional dyes can be used. For accommodating these dyes in the porous film, for example, these dyes may be dissolved in an appropriate solvent such as a organic solvent, e.g. tetrahydrofuran, methylethylketone, or ethyl alcohol, the solution being applied on one or both sides of the film by any conventional means, such as a Meyer bar or a knife coater. Instead of the coating, the porous film may be immersed in a dye solution. Subsequent drying for the removal of the solvent accomplishes the formation of the donor layer. Since the solvent does not contain a binder, the dyes are not accompanied by a binder. Thus, the dyes are captured in the pores in a binder-fee state, thereby eliminating the aforementioned problems associated with the use of binders in dye diffusion thermal transfer systems. The overall concentration of dyes in the above-mentioned dye solution depends on the type of dye, but is generally in the range of 1–10% by weight, preferably 2–7% by weight.

In a preferred embodiment of this invention, for the purpose of enhancing the mechanical strength of the porous film of the present invention, a protective layer is placed on the surface of the above-mentioned porous film opposite the surface on which the donor layer is placed (in the case where the donor-layer is formed on only one of the surfaces of the porous film). The protective layer may be very thin, and have a thickness in the range of 1 μm to 10 μm, preferably 1 μm to 3 μm.

The protective layer serves to prevent thermal influences from thermal head, i.e., to prevent the thermal fusion of the porous film, and can be formed by applying a solution of polymer having a high glass transition temperature on the surface of the porous film opposite the surface having the donor layer placed thereon, followed by drying. The polymers that can be used for this purpose are polyvinyl alcohol, polyvinylpyrrolidone, and the like. Any solvent can be used for this purpose as long as it can dissolve the polymer to be used. For example, water, a mixture of water with a hydrophilic organic solvent, or the like can be used. The concentration of the polymer in the solvent is 1–10% by weight, preferably 3–5% by weight. For the formation of the protective layer by the above-mentioned method, after applying the dye solution on one side of the porous film, followed by drying, the solution of the polymer for the protective film may be applied on the other side of the porous film, and then dried.

The protective layer may also be formed by laminating a thin film on the porous film. As this film, a polyethylene terephethalate (PET) film, a polyethylene naphthalate (PEN) film, a polyimide film, a polyamide film, a polycarbonate film, or the like can be used.

The receptor film which can be applied to the donor film of this invention is comprised of a substrate film and a receptor layer formed on the surface thereof. The receptor layer is, for example, comprised of a layer of polyvinyl chloride, a copolymer of vinyl chloride and vinyl acetate, polyester, polycarbonate, etc. The receptor layer can be formed by dissolving one of these materials in an appropriate solvent, and then applying the solution on the substrate film, followed by drying. Any conventional substrate film can be used.

Advantageously, the porous donor film of the present invention allows the diffusion of dyes to be carried out at a low thermal energy. As a result, an image with a high continuous gradation, even in the case of a low optical density, can be formed. Also, the service life of the thermal head can be extended.

In order for the invention to be more readily understood, reference is made to the following non-limiting examples and comparative examples.

(1) Dye Mixture Preparation

Dye mixtures were prepared by dissolving the following dyes in tetrahydrofuran (THF) and then mixing them, respectively. Each concentration of the dye was adjusted to 5% by weight. Each of the dye formulas are set forth below.

1. Cyan dye mixture:

4 g of #1 dye solution (a solution of Foron Brilliant Blue™, produced by Sandos, U.S.A. [see Formula 1])+5 g of #2 dye solution (produced by 3M, U.S.A. [see Formula 2])

2. Magenta dye mixture:

3 g of #3 dye solution (a solution of HSR-31™ produced by Mitsubishi Chemical Industries Limited [See Formula 3])+3 g of #4 dye solution (produced by 3M, U.S.A. [See Formula 4])

3. Yellow dye mixture:

2 g of #5 dye solution (a solution of MQ-452™ produced by Nippon Kayaku Co. Ltd. [See Formula 5])+1 g of #6 dye solution (produced by 3M, U.S.A. [See Formula 6]) + 1 g of #7 dye solution (produced by 3M, U.S.A. [See Formula 7])

#1 Dye

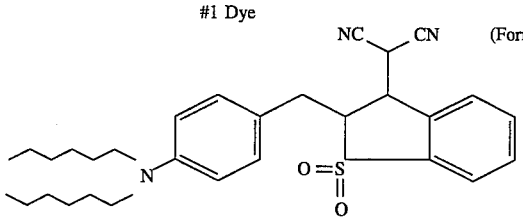

(Formula 1)

#2 Dye

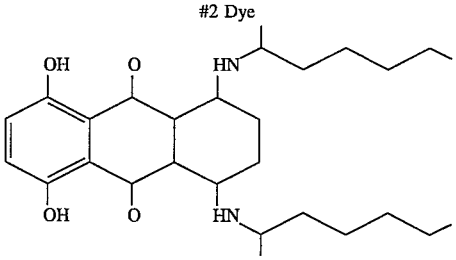

(Formula 2)

#3 Dye

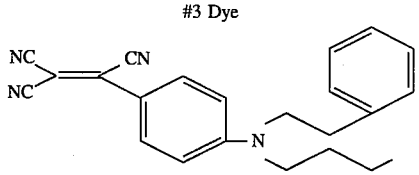

(Formula 3)

#4 Dye

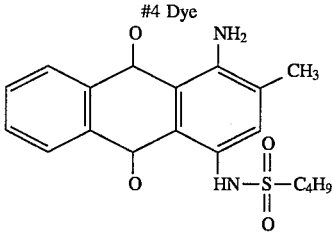

(Formula 4)

#5 Dye

-continued

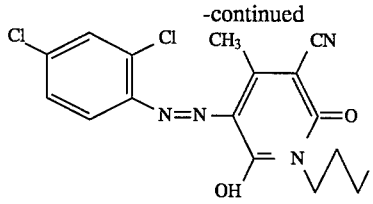

(Formula 5)

#6 Dye

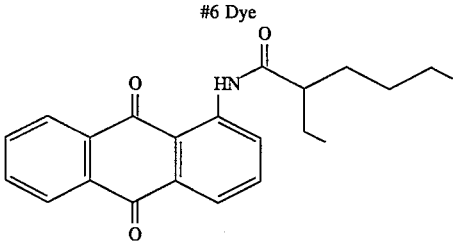

(Formula 6)

#7 Dye

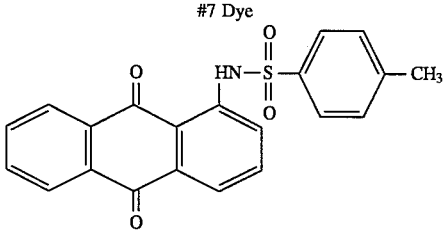

(Formula 7)

(2) Donor Layer Preparation properties of the films used are as shown in Table 1.

TABLE 1

| Material | Tm (° C.) | Thickness (μm) | Gurley (sec/50 cc air) |
|---|---|---|---|
| Polyethylene film #06101-5 | 124–131 | 14 | 19 |
| Polypropylene film #770-28 | 163–167 | 20 | 10 |
| Polypropylene film #770-2S | 159–163 | 25 | 400 |
| Polypropylene film #770-3S | 158–163 | 17 | 240 |
| Polypropylene film #770-4S | 158–162 | 15 | 400 |
| Polypropylene film #770-6S | 155–160 | 10 | — |
| Polypropylene film #739-2B | 158–162 | 20 | 34 |
| Paper | — | 22 | — |

Seven types of the porous donor film were produced.

Type 1

Porous polyethylene film #0610-5 (from 3M, U.S.A.) was placed on a paper, and a solution of dye mixture in THF was coated on the film using a #10 Meyer bar. After being dried at 65° C. for 20 minutes, an aqueous 5% by weight solution of polyvinyl alcohol having a polymerization degree of 2000 was coated on the surface which was not dye-coated using a #10 Meyer bar, and dried again under the same conditions.

Type 2

Figure 2:
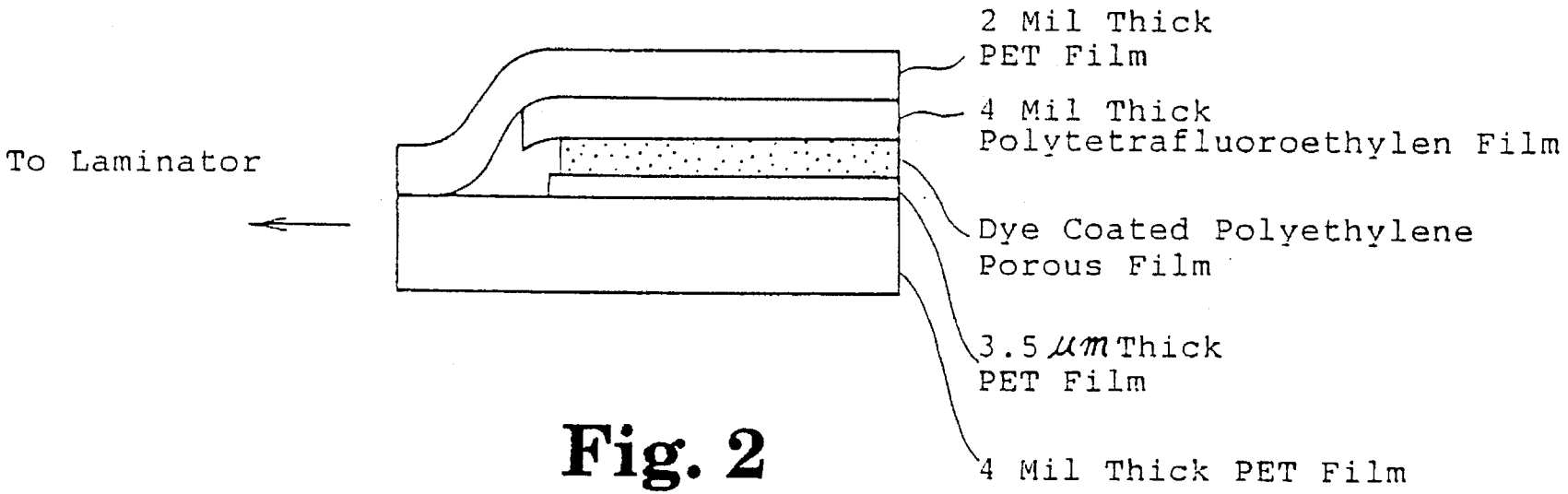
FIG. 2 shown the lamination condition of the type 1 laminated film of this invention during the course of production.

A porous donor film using porous polyethylene film #0610-5 (from 3M, U.S.A.) was prepared in the same manner as that in type 1. A 3.5 μm thick PET film was laminated thereon instead of coating it with polyvinyl alcohol. The lamination was carried out using a laminator produced by Gunma Ushio at 110° C. at a speed of 9.5 mm/sec. The film lamination process is shown in FIG. 2.

Type 3

A porous polyethylene film #06101-5 (from 3M, U.S.A.) was placed on a 3.5 μm thick PET film, and a dye mixture in THF was coated on the surface thereof using a #10 Meyer bar. It was then dried at 65° C. for 20 minutes.

Type 4

A porous polyethylene film #06101-5 (from 3M, U.S.A.) was dipped in a solution of magenta dye mixture in THF. After dried at 65° C. for 20 minutes, the 3.5 mm thick PET film was laminated on the surface thereof as mentioned under type 2.

Type 5

Porous polypropylene films (#770-28, #770-2S, #770-3S, #770-4S, #770-6S, and #739-2B, all from 3M, U.S.A.) were prepared in the same manner as that in type 1.

Type 6

A porous polypropylene film #770-2S was prepared in the same manner as that in type 1, but the film did not have the PET film layer. Furthermore, when printing, neither an anti-stick agent nor a slipping agent for the thermal head was used.

Type 7

A donor film was prepared by using thin paper, and it was evaluated.

All samples with the exception of the donor films used in type 6 and type 7 were coated on the opposite surface of the dye-coated surface with a 2% silicon grease in toluene, in order to prevent sticking by the thermal head, and the grease was then wiped off gently.

(3) Receptor Layer Preparation

A polyvinyl chloride (PVC) resion from Mitsubishi Kasei Vinyl was dissolved in tetrahydrofuran (THF) to prepare a 5% weight PVC solution. Separately, a solution of an anti-blocking agent (5% by weight of FC430, from 3M, U.S.A., in THF) was prepared. The mixed solution prepared therefrom (10 g of the PVC solution+0.5 g of the FC430 solution) was coated on the surface of a 4 mil thick polyethyleneterephtalate (PET) film using a #20 Meyer bar. After being dried at 65° C. for 20 minutes, this film was used as a receptor film.

(4) Thermal Printer and Printing Conditions

Figure 3:
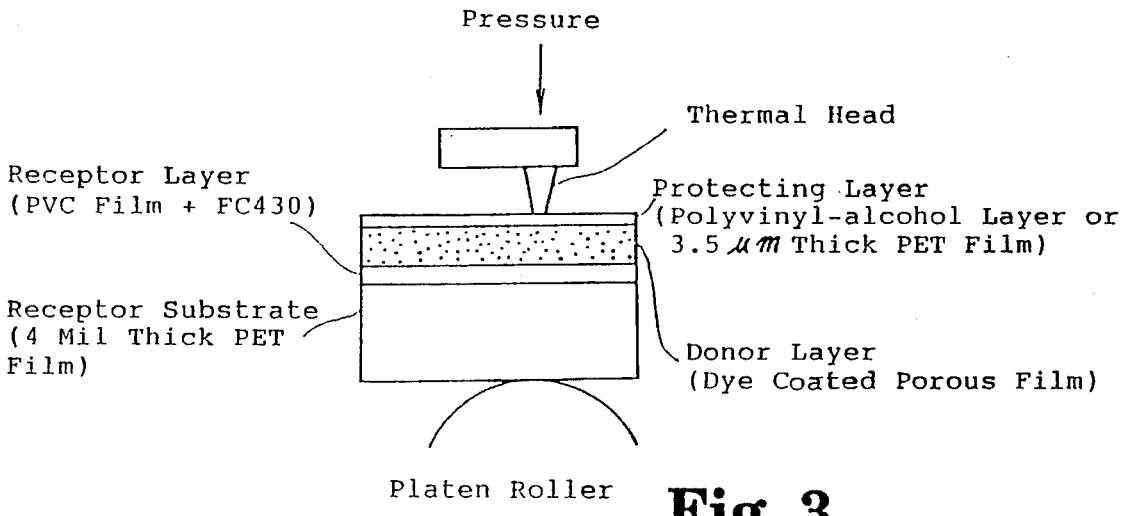
FIG. 3 shows one embodiment of the image forming system to which the donor film of this invention is applied.
Figure 4:
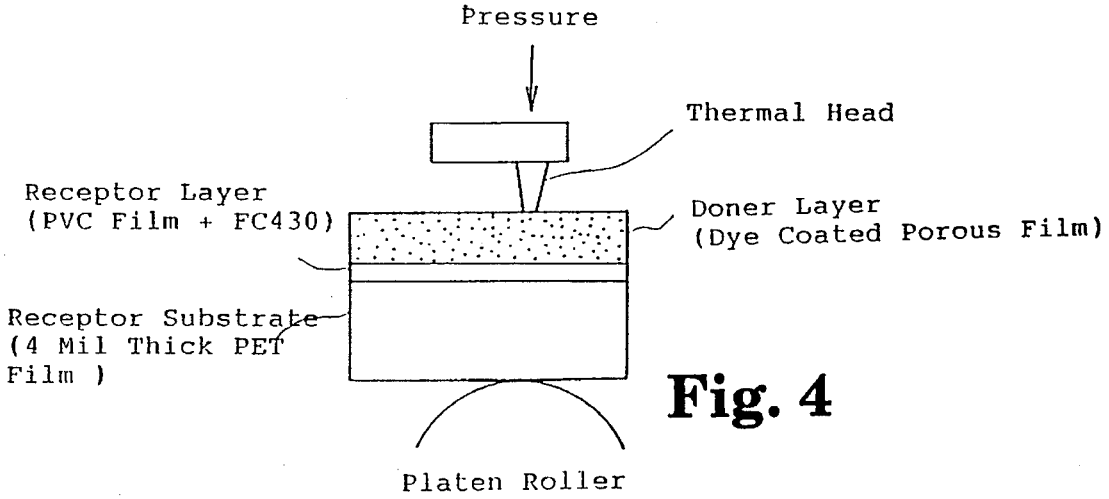
FIG. 4 shows another embodiment of the image forming system to which the donor film of this invention is applied.

A thermal printer having a 200 dpi, 13.4 cm width thermal head (from 3M, U.S.A.) was employed to carry out printing evaluations. For applying pressure, a 1.95 kg weight was placed on the thermal head. FIG. 1, FIG. 3 and FIG. 4 schematically show the various imaging configurations used to carry out the examples and comparative examples set forth below. FIGS. 3 and 4 are in accordance with the present invention. The imaging process was carried out in eight steps by varying the voltage applied to the thermal head. The burn times and thermal energies are shown in the following table 2.

TABLE 2

| | Step | | | | | | | |
|---|---|---|---|---|---|---|---|---|
| | 1 | 2 | 3 | 4 | 5 | 6 | 7 | 8 |
| Burn Time/msec | 0.56 | 1.12 | 1.68 | 2.24 | 2.80 | 3.36 | 3.92 | 4.48 |
| Thermal energy/J/cm$^2$ at 11.5 volts | 0.49 | 0.99 | 1.49 | 1.99 | 2.49 | 2.99 | 3.49 | 3.98 |
| Thermal Energy/J/cm$^2$ at 14.0 Volts | 0.73 | 1.47 | 2.21 | 2.95 | 3.69 | 4.43 | 5.17 | 5.91 |
| Thermal Energy/J/cm$^2$ at | 1.08 | 2.17 | 3.26 | 4.35 | 5.44 | 6.53 | 7.62 | 8.71 |

TABLE 2-continued

| | Step | | | | | | | |
|---|---|---|---|---|---|---|---|---|
| | 1 | 2 | 3 | 4 | 5 | 6 | 7 | 8 |
| 17.0 Volts | | | | | | | | |

(5) Image density evaluation

In order to measure an optical transmission density, a densitometer, (Macbeth TR924, from Macbeth Process Measurement, U.S.A.) was utilized. A type filters were used.

EXAMPLE 1

Figure 5:
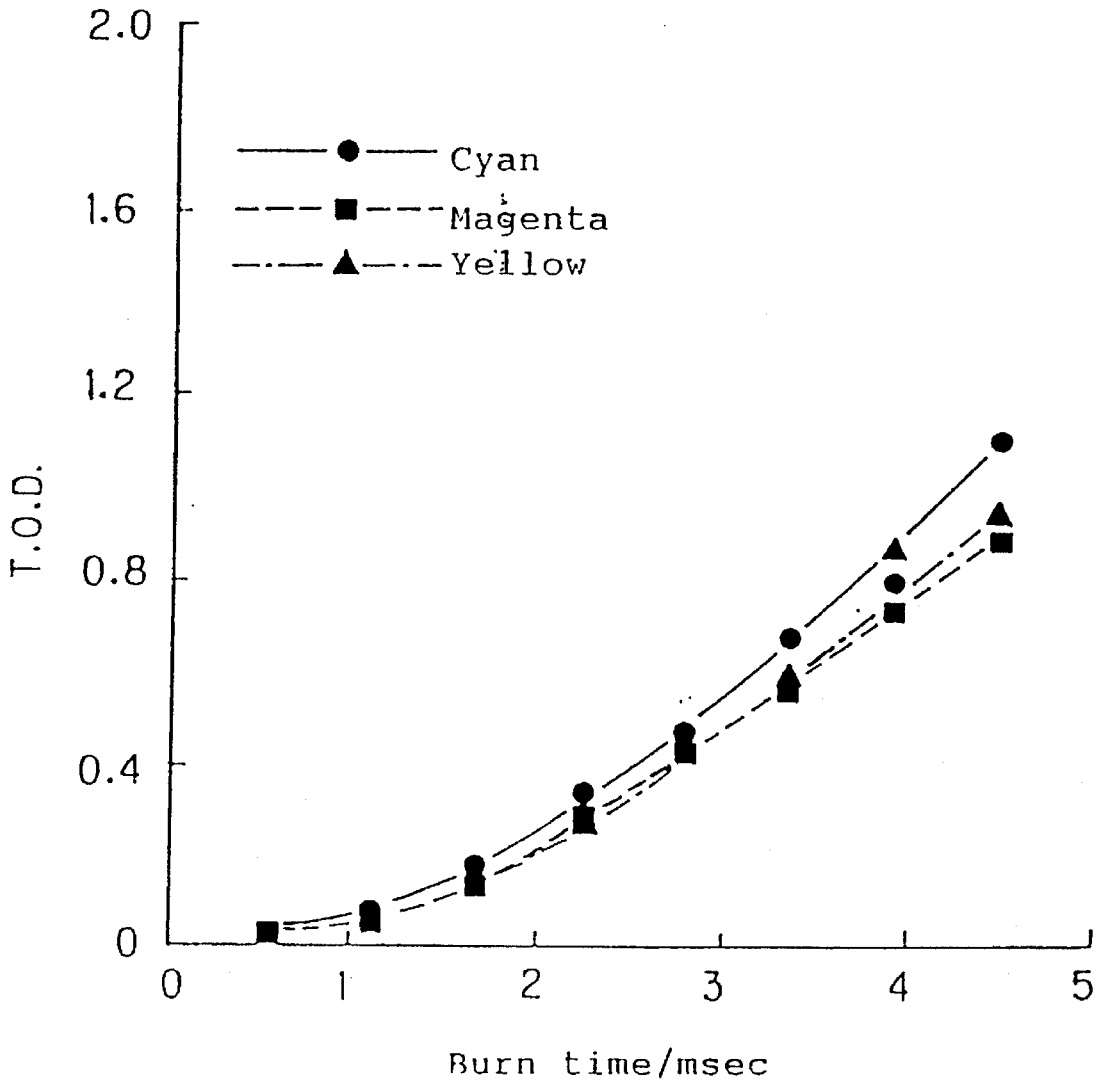
FIG. 5 shows a relation between burn time and the image density obtained in Example 1.

The porous donor films (type 1) were tested using a thermal printer at an applied voltage of 11.5 volts, and a linear image gradation was attained. The result is shown in FIG. 5. When more than 11.5 volts was applied, the donor films were partially melted by the heat. These donor films did not stick nor did they cause transfer of the dye mixture to the receptor layer upon the application of pressure only.

COMPARATIVE EXAMPLE 1

Figure 6:
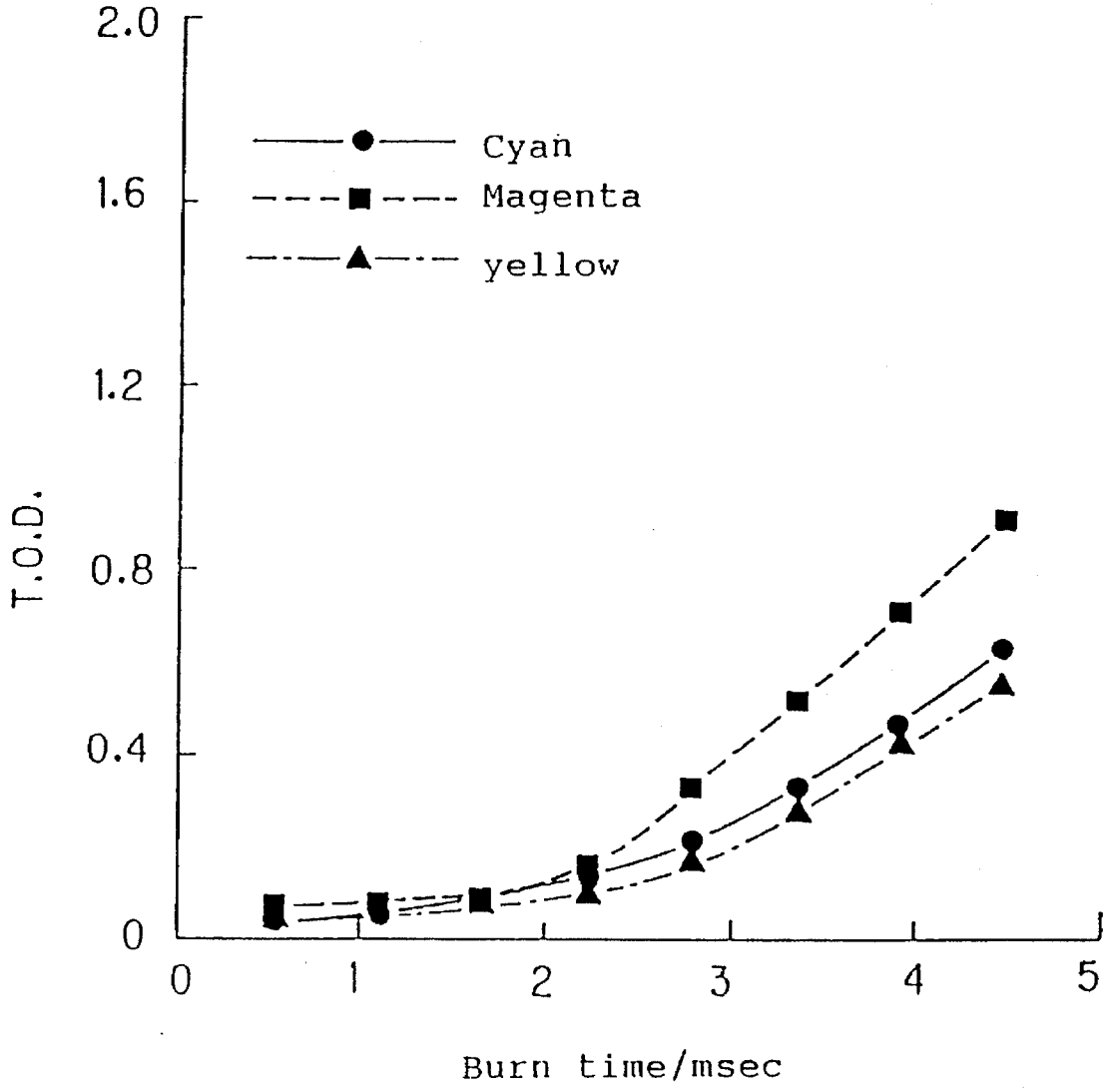
FIG. 6 shows a relation between burn time and the image density obtained in Comparative Example 1.

Three types of ink ribbon having different dyes (cyan, magenta, and yellow) were produced. First, dye solutions comprised of dyes, cellulose acetate, an anti-blocking agent and MEK were coated on the surface of a 6 μm thick PET film using a #10 Meyer bar, and then dried at 60° C. for 10 minutes in an oven. Thereafter, an ink ribbon which is a donor layer of 5 nm thickness was evaluated in the same manner as that of Example 1. They showed a low sensitivity to the applied thermal energy in comparison with those of the donor films (type 1). The result is shown in FIG. 6. As illustrated, they required higher energies for dye diffusion in comparison with type I films. Moreover, the magenta ink ribbon carried out the transfer of the color material to the receptor by the application of pressure only.

COMPARATIVE EXAMPLE 2

Figure 7:
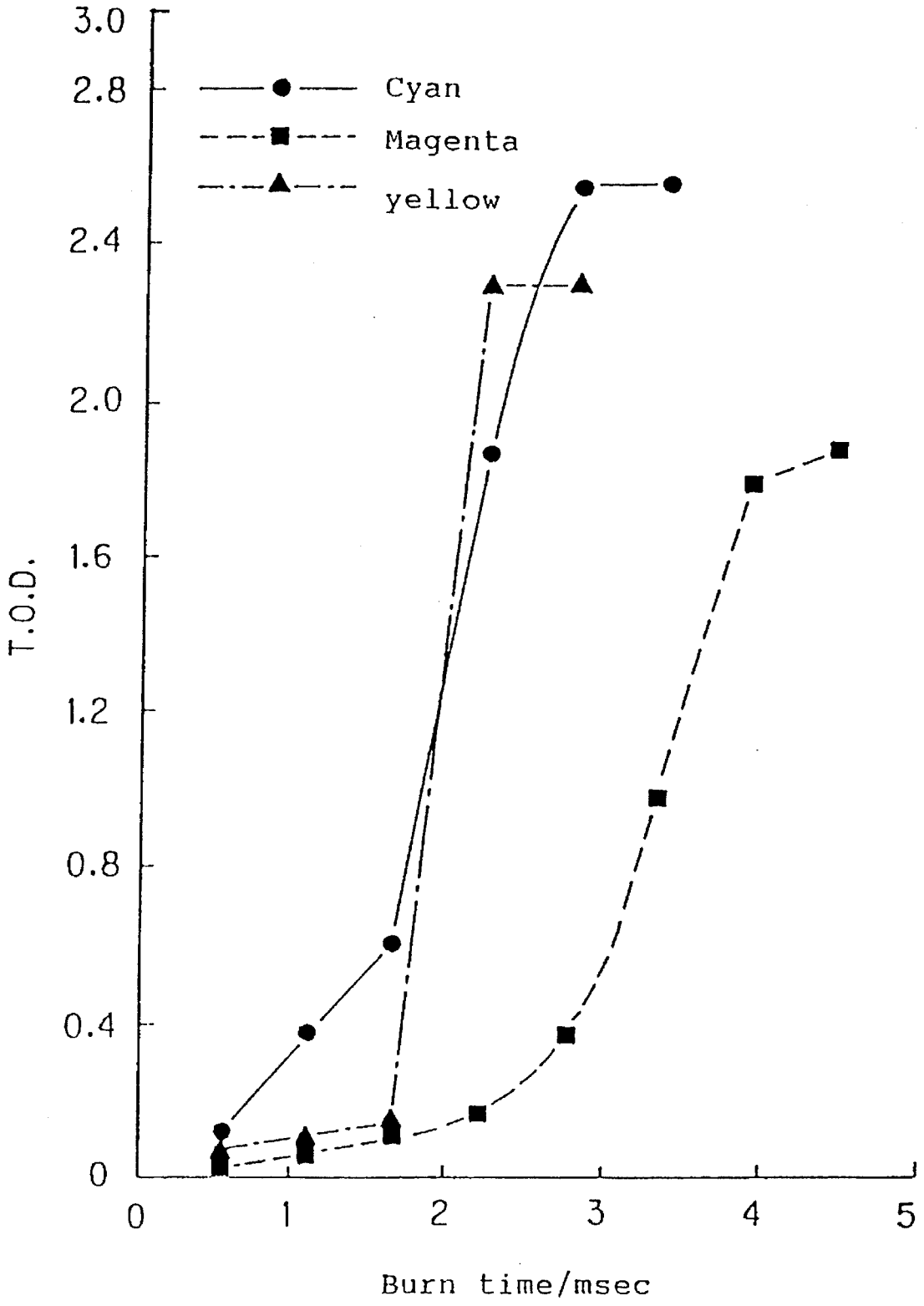
FIG. 7 shows a relation between burn time and the image density obtained in Comparative Example 2.
Figure 8:
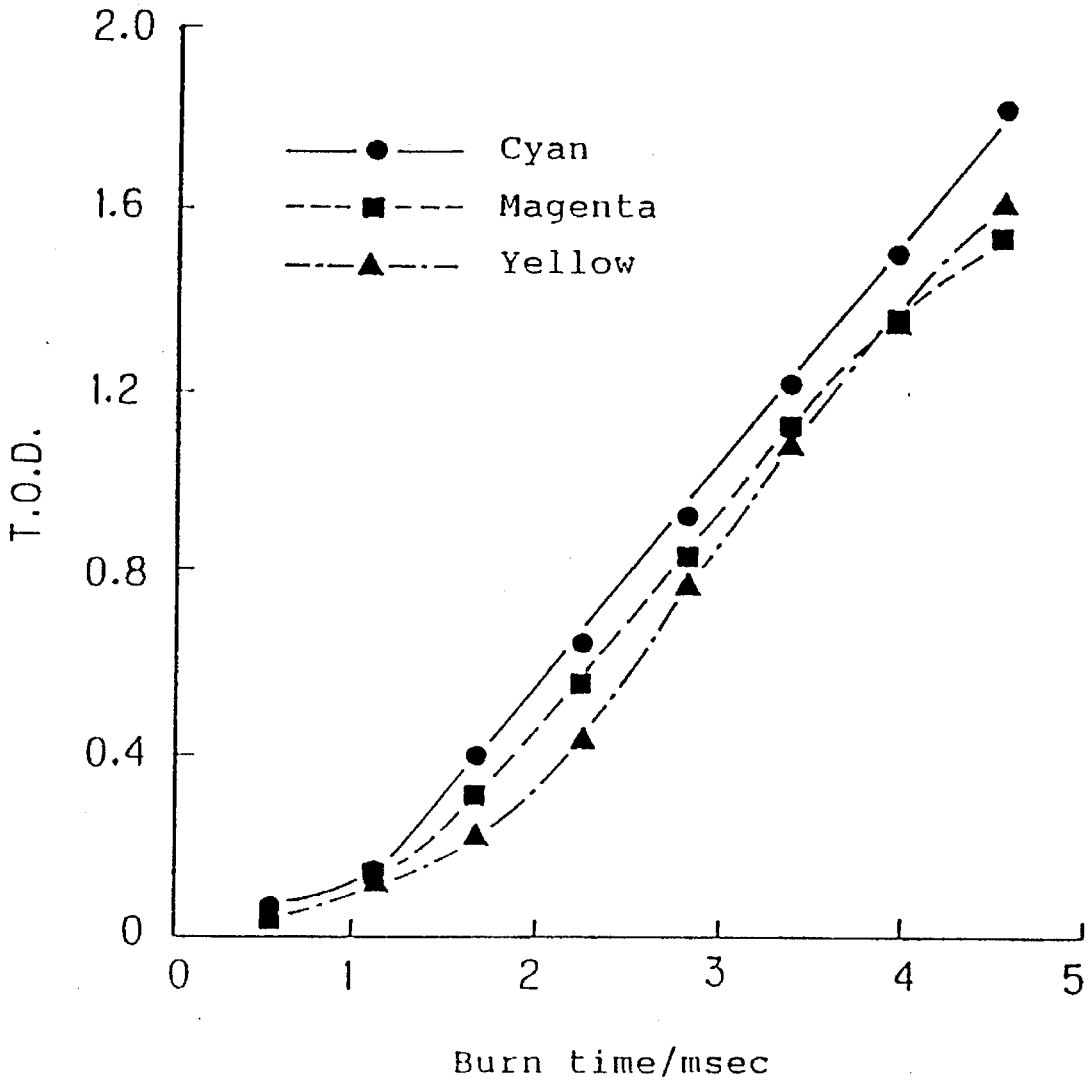
FIG. 8 shows a relation between burn time and the image density obtained in Example 2.

Three types of dye mixed solutions were coated on the surface of a 6 μm thick PET film using a #10 Meyer bar, and then dried to prepare cyan, magenta, and yellow ink ribbons. Thereafter, they were evaluated in the same manner as that of Example 1. The result is shown in FIG. 7. They showed almost no gradation. The magenta ink ribbon demonstrated an apparent gradation, but the printed images showed the transfer of a solid dye. Almost all of the images were produced by mass transfer.

EXAMPLE 2

For improving the heat performance, type 2 donor films were chosen. The printing conditions were the same as those of Example 1, except for applied voltage, the voltage being increased from 11.4 volts to 14.0 volts. The optical densities of the printed images are clearly in a good linear relation to the thermal energy applied from the thermal head as in Example 1. The results is shown in FIG. B.

Moreover, the sensitivity to dye diffusion remained high, and dye transfer to the receptor layer due to pressure only was not observed.

COMPARATIVE EXAMPLE 3

Figure 9:
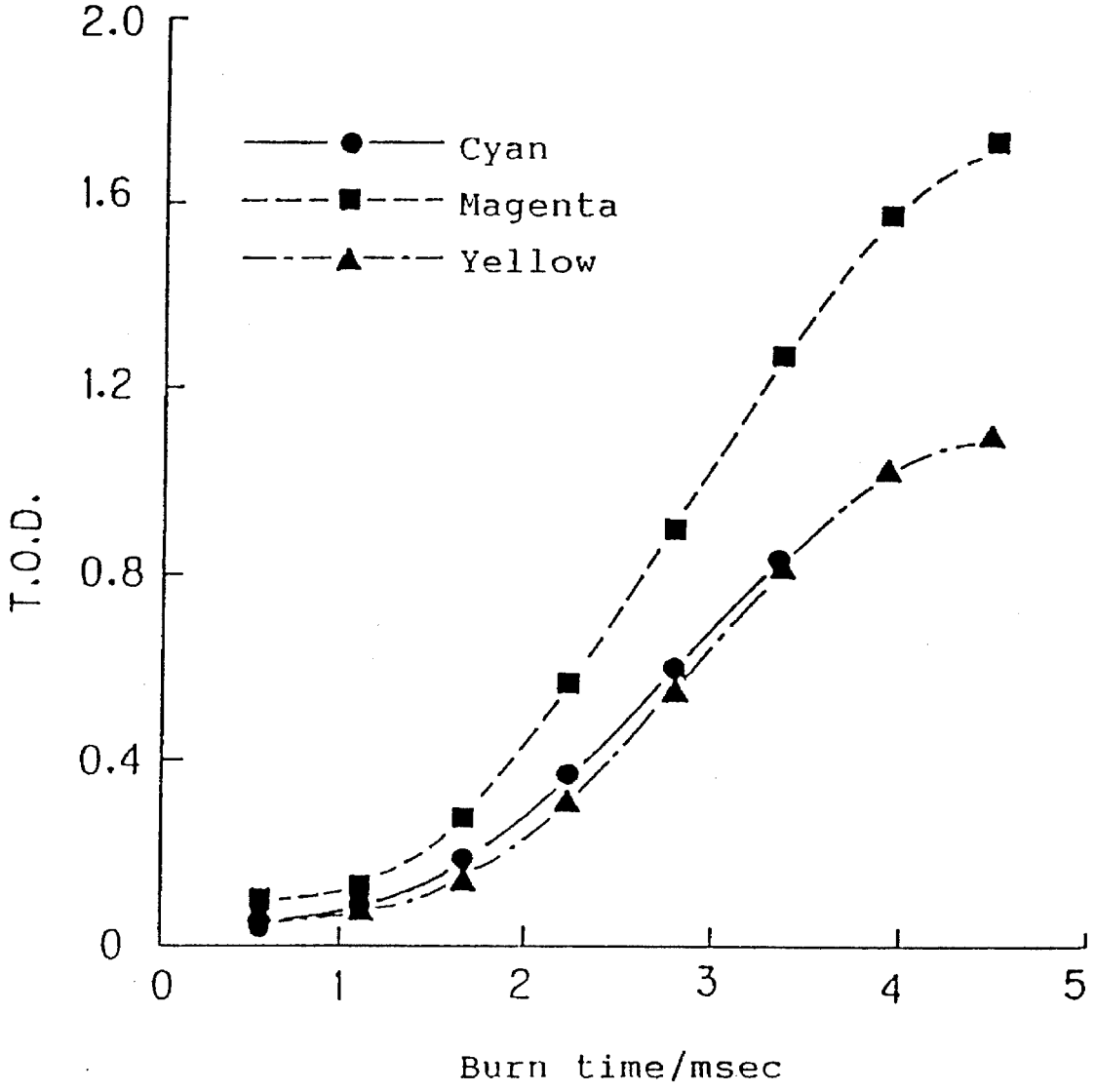
FIG. 9 shows a relation between burn time and the image density obtained in Comparative Example 3.

Three types of ink ribbons as shown in FIG. 1 were prepared using the same dyes and examined in the same manner as in Example 2. The result is shown in FIG. 9. The magenta ink ribbon showed a better thermal sensitivity than the others, but the dye transfer to the receptor layer because of pressure was shown and, thus, the Dmin was raised. The cyan ink ribbon was sticking to the receptor layer at the 7th or more level. Their total thermal sensitivities were lower than that of type 2 donor film.

COMPARATIVE EXAMPLE 4

Figure 10:
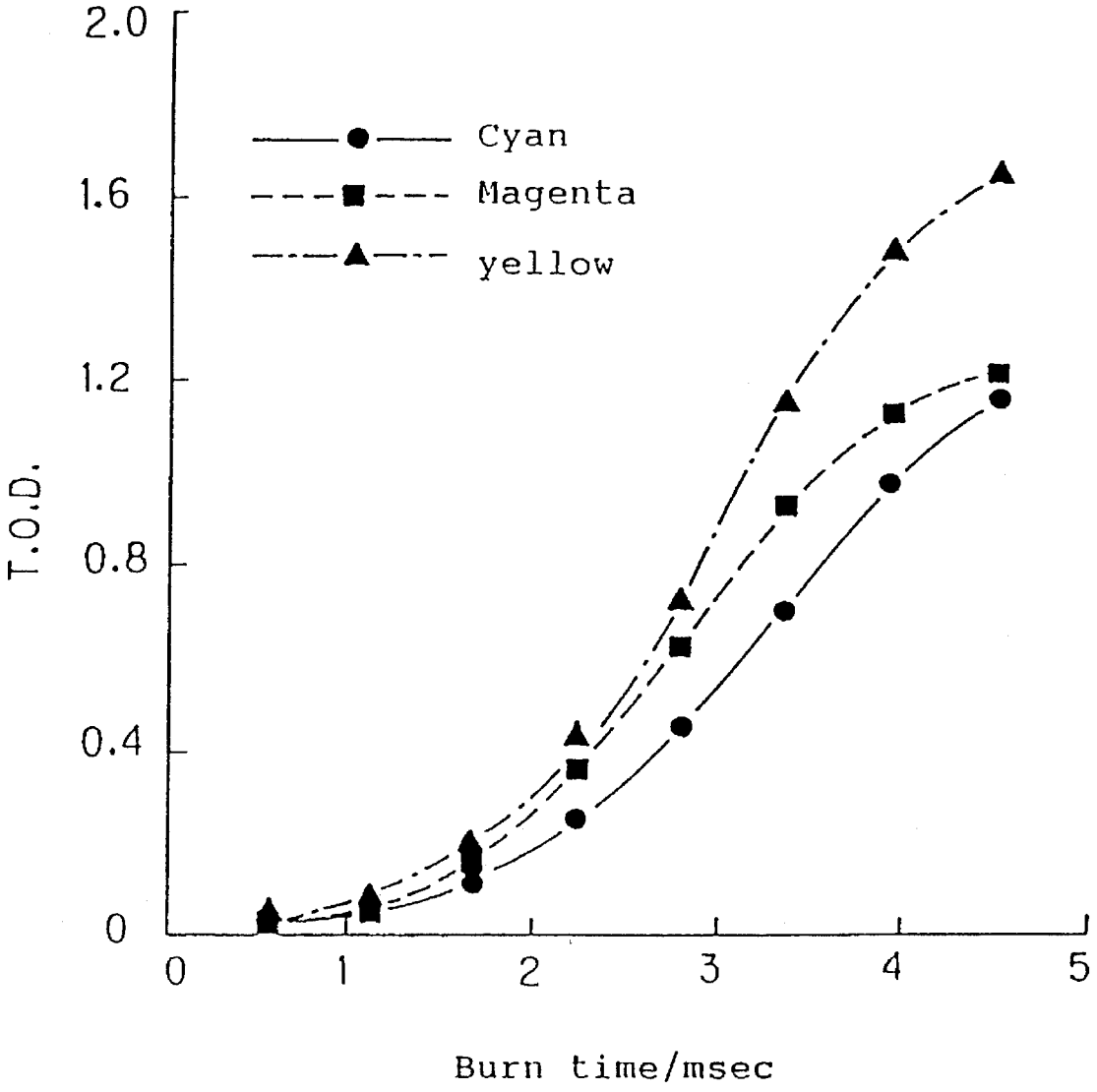
FIG. 10 shows a relation between burn time and the image density obtained in Comparative Example 4.

Three commercially available ink ribbons (from A company) were examined in the same manner as in Example 2. The result is shown in FIG. 10. Their thermal sensitivities were low except for the yellow ribbon.

COMPARATIVE EXAMPLE 5

Figure 11:
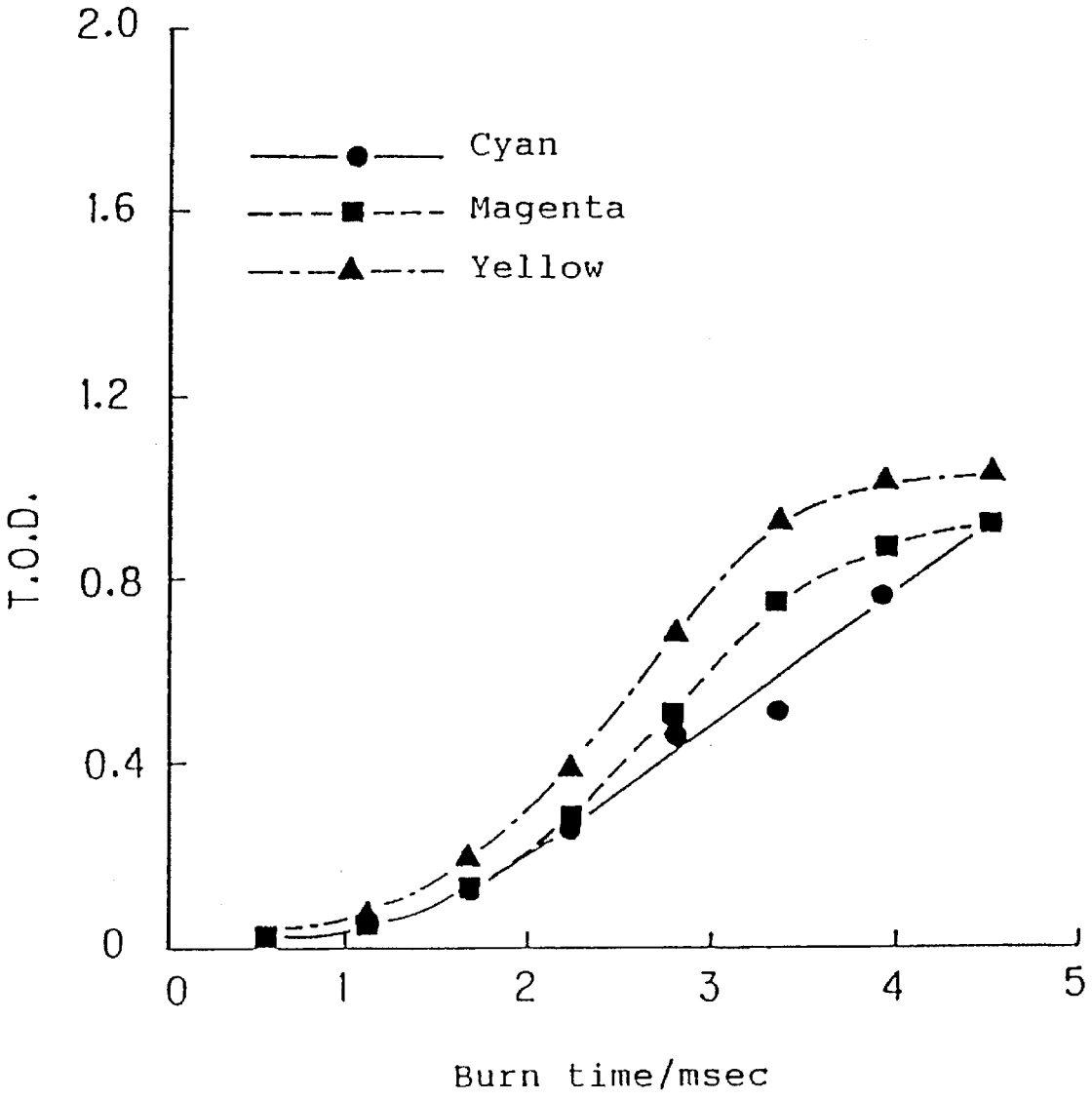
FIG. 11 shows a relation between burn time and the image density obtained in Comparative Example 5.

Three commercially available ink ribbons (from B company) were examined in the same manner as in Example 2. The result is shown in FIG. 11. All of the ribbons had low thermal sensitivities, and the range of the image density from Dmax to Dmin was too narrow.

COMPARATIVE EXAMPLE 6

Figure 12:
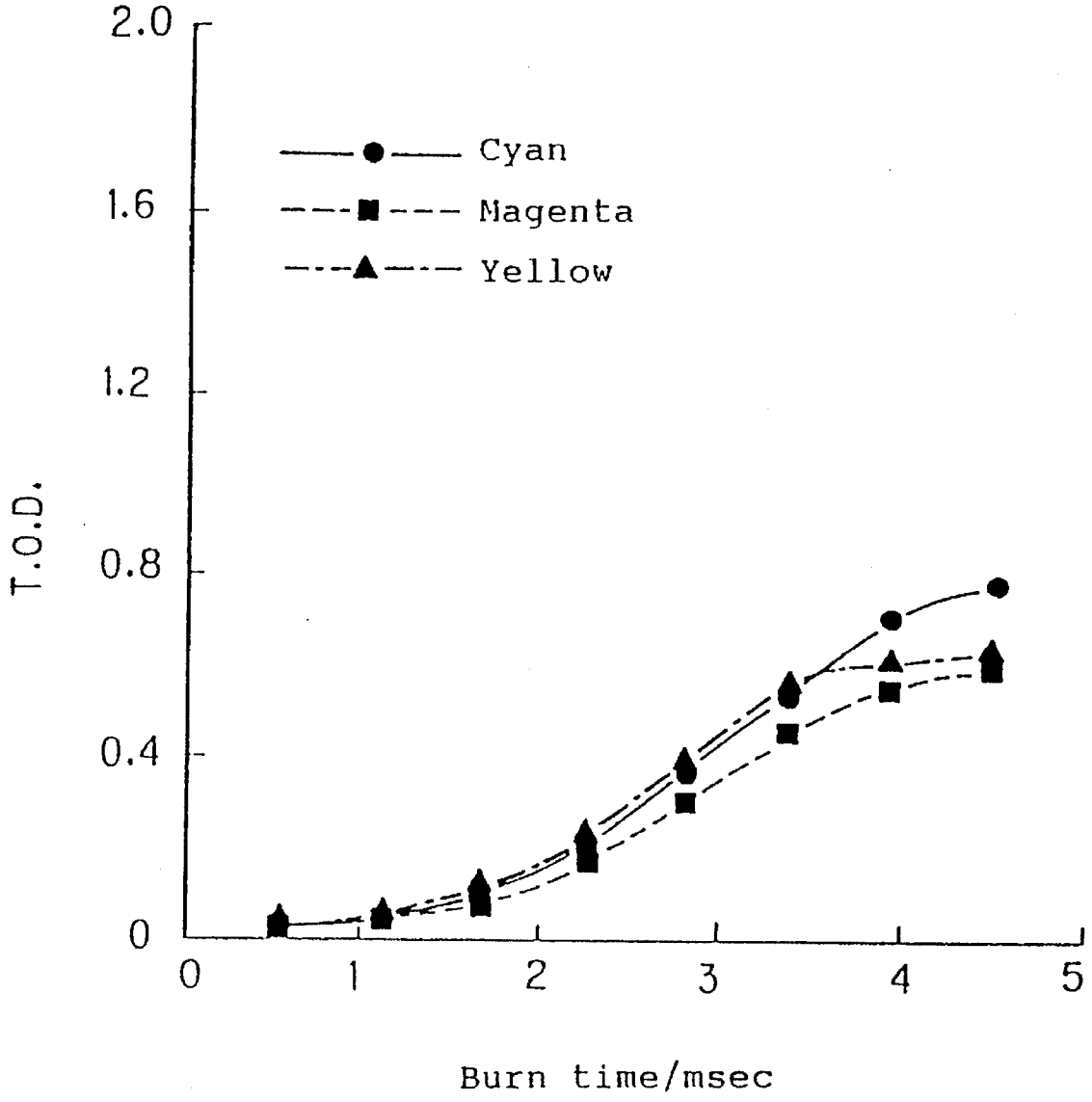
FIG. 12 shows a relation between burn time and the image density obtained in Comparative Example 6.

Three commercially available ink ribbons (from C company) were examined in the same manner as in Example 2. The result is shown in FIG. 12. They also had low thermal sensitivities, and covered a narrow image density range.

EXAMPLE 3

Figure 13:
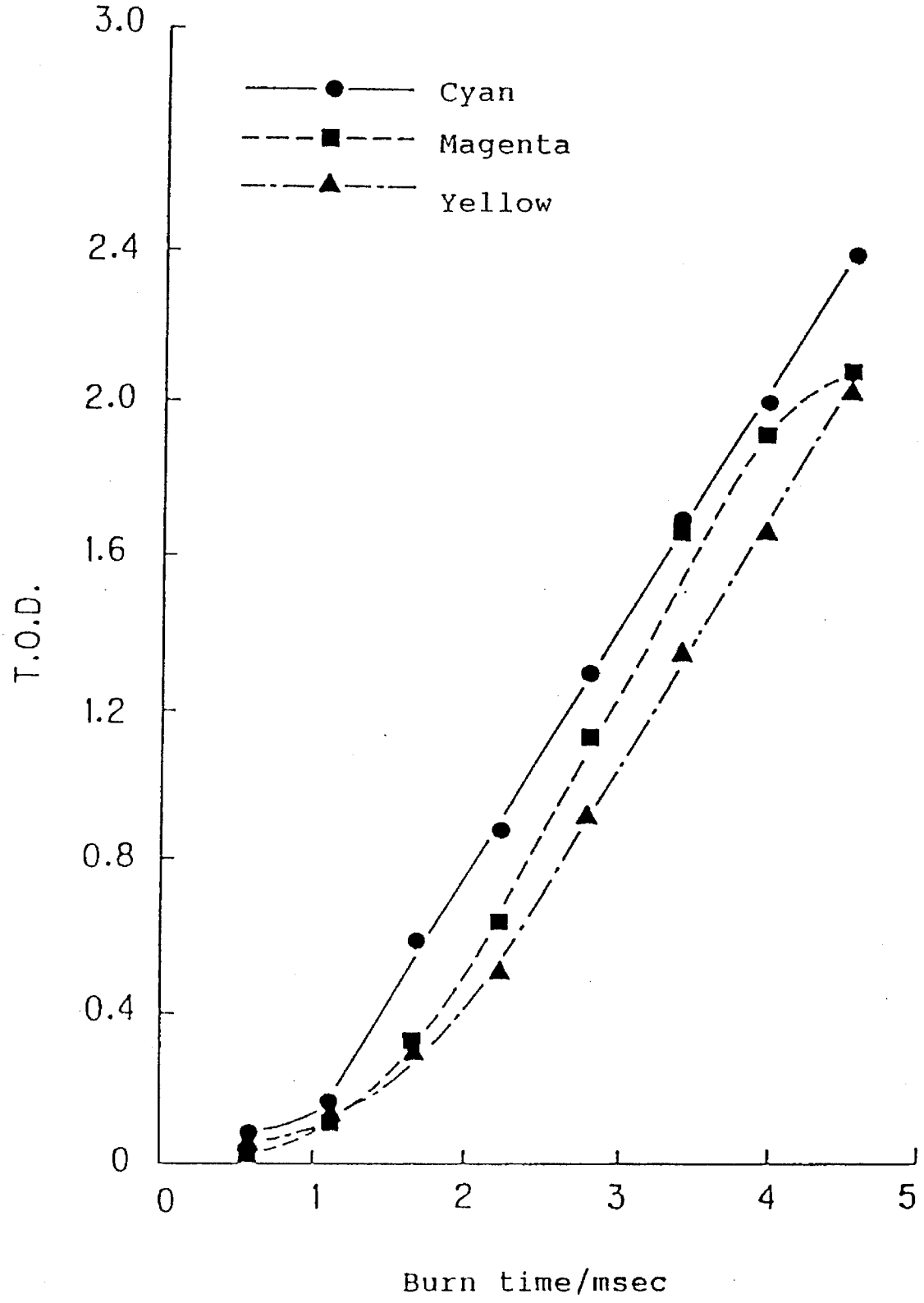
FIG. 13 shows a relation between burn time and the image density obtained in Example 3.

Porous donor films (type 3) were prepared to increase the range between Dmax and Dmin of the image production. The printing conditions were the same as those of Example 2. Their optical densities are in a linear relation to the applied thermal energy. The energy requirement for the cyan image was 5.1 Joule/cm$^2$ and those for the magenta and yellow images were 5.9 Joule/cm$^2$. The result is shown in FIG. 13. These values are quite a bit smaller than those of the commercially available type donor films.

EXAMPLE 4

Figure 14:
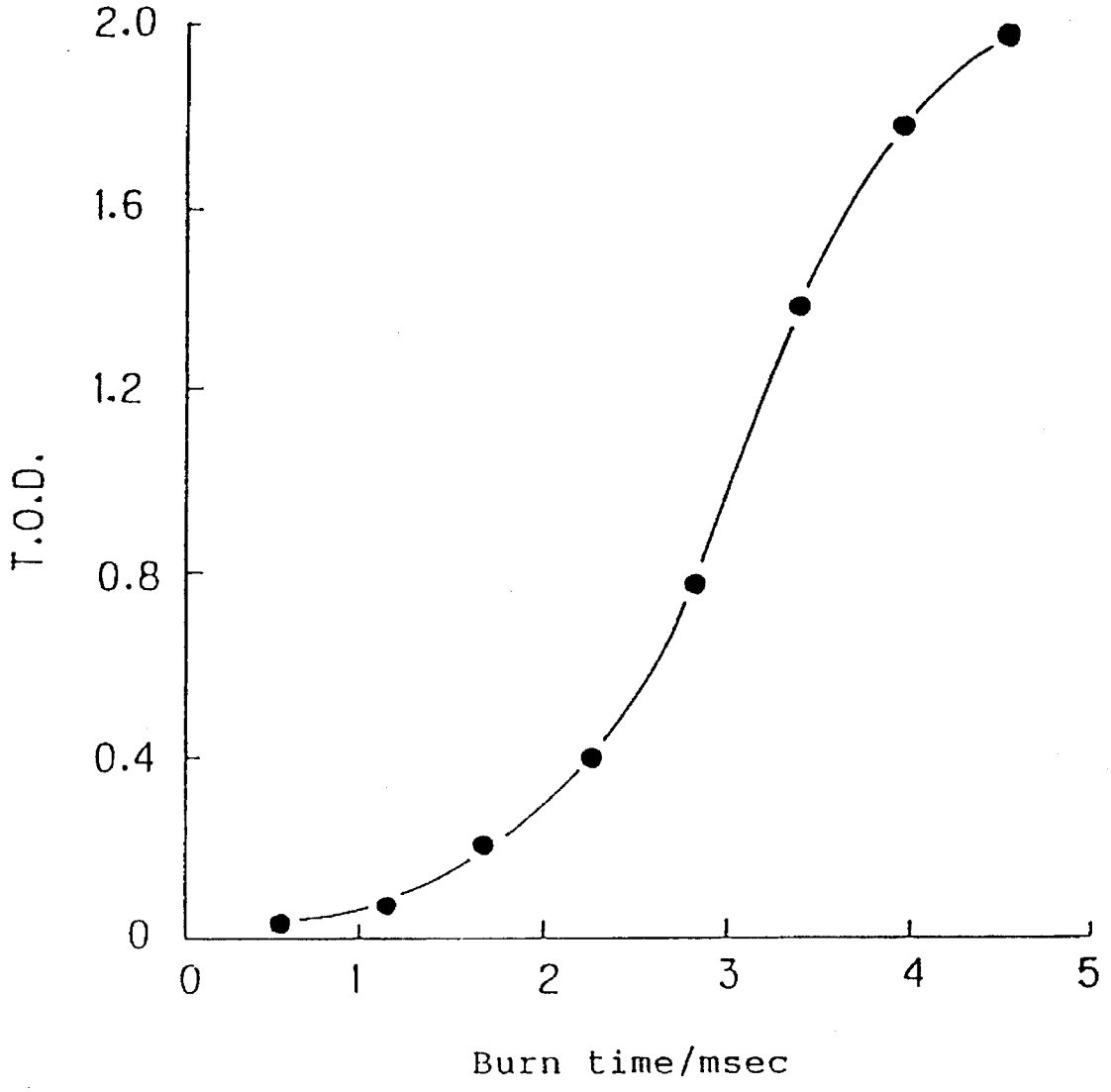
FIG. 14 shows a relation between burn time and the image density obtained in Example 4.

Porous donor films (type 4) were examined in the same manner as that in Example 2. The image gradation was also observed. The result is shown in FIG. 14. From this example, it can be considered that there is no need for a special coater for producing the donor films. Only the process of dipping the porous film into the dye solution is required.

EXAMPLE 5

Figure 15:
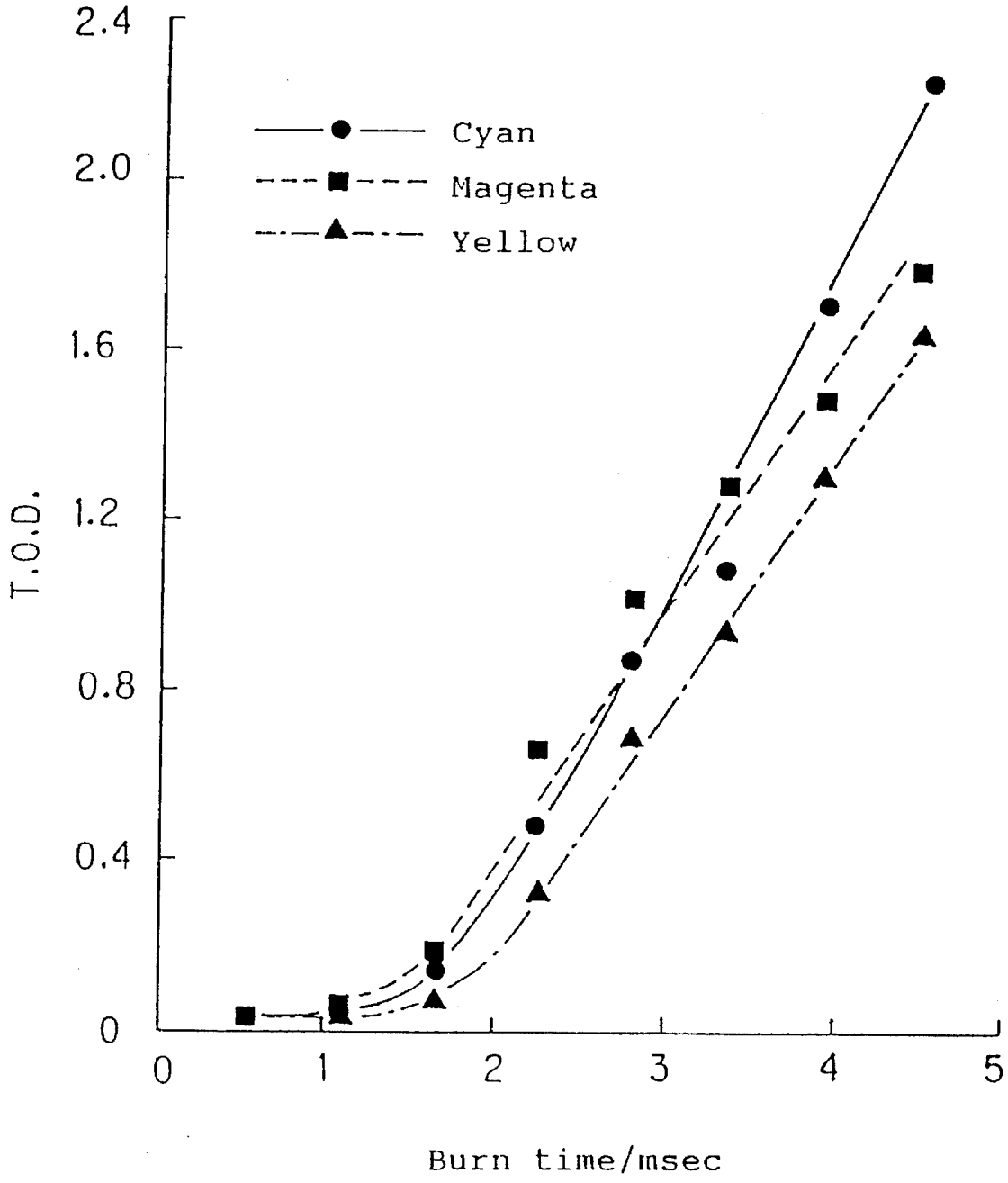
FIG. 15 shows a relation between burn time and the image density obtained in Example 5.

Porous polypropylene film (type 5, #770-28, from 3M, U.S.A.) was evaluated in the same manner as that in Example 1, except that the applied voltage was increased to 17.0 volts. As a result, it was found that the optical densities on a receptor layer were in linear relation to the applied thermal energy during the printing. The result is shown in FIG. 15.

EXAMPLE 6

Figure 16:
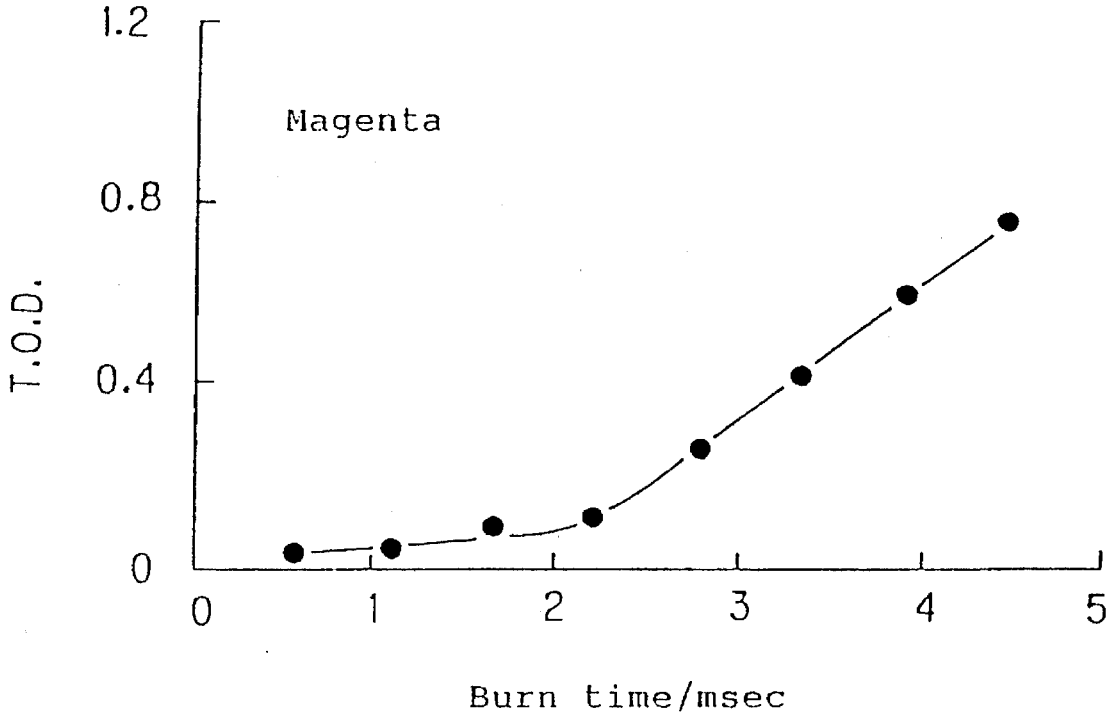
FIG. 16 shows a relation between burn time and the image density obtained in Example 6.

Porous polypropylene films (type 5, #770-2S, from 3M, U.S.A.), were evaluated in the same manner as that in Example 5. The result demonstrates that the optical densities of the printed images on a receptor layer showed gradation. Furthermore, they were changed in linear relation to the applied thermal energy. The result is shown in FIG. 16.

EXAMPLE 7

Figure 17:
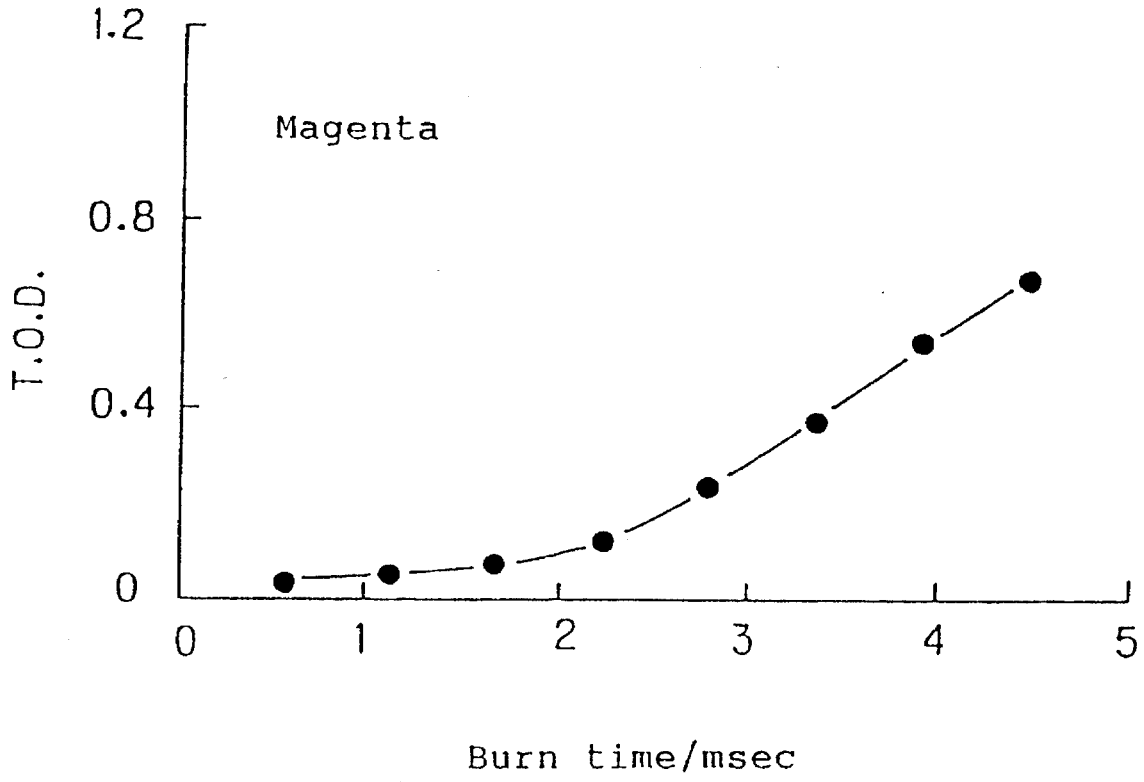
FIG. 17 shows a relation between burn time and the image density obtained in Example 7.

When type 6 porous polypropylene films (#770-2S) were evaluated in the same manner as that in Example 5, substantially the same results as those in Example 6 were obtained. The result is shown in FIG. 17. The result indicates that the basic thermal diffusion of dye from the donor layer into the pores of the receptor layer can be carried out by using the donor as shown in FIG. 4, not requiring a polyvinyl alcohol or PET film as shown in FIG. 3.

EXAMPLE 8

Figure 18:
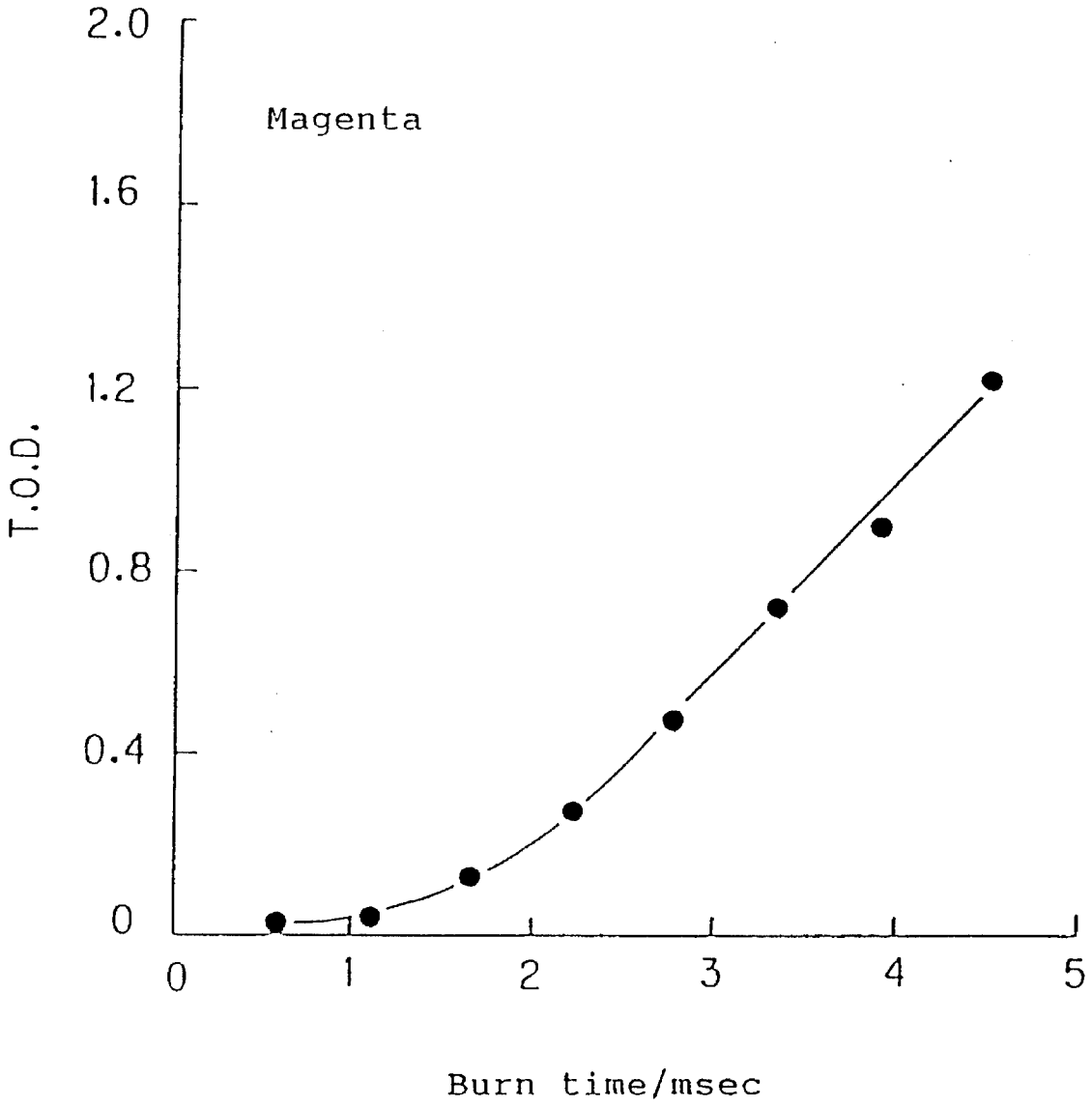
FIG. 18 shows a relation between burn time and the image density obtained in Example 8.

When type 5 porous polypropylene films (#739-2B, from 3M, U.S.A.) were evaluated in the same manner as that in Example 5, optical densities of the printed images on a receptor layer showed gradation, and were in linear relation to the applied thermal energy. The result is shown in FIG. 18.

EXAMPLE 9

Figure 19:
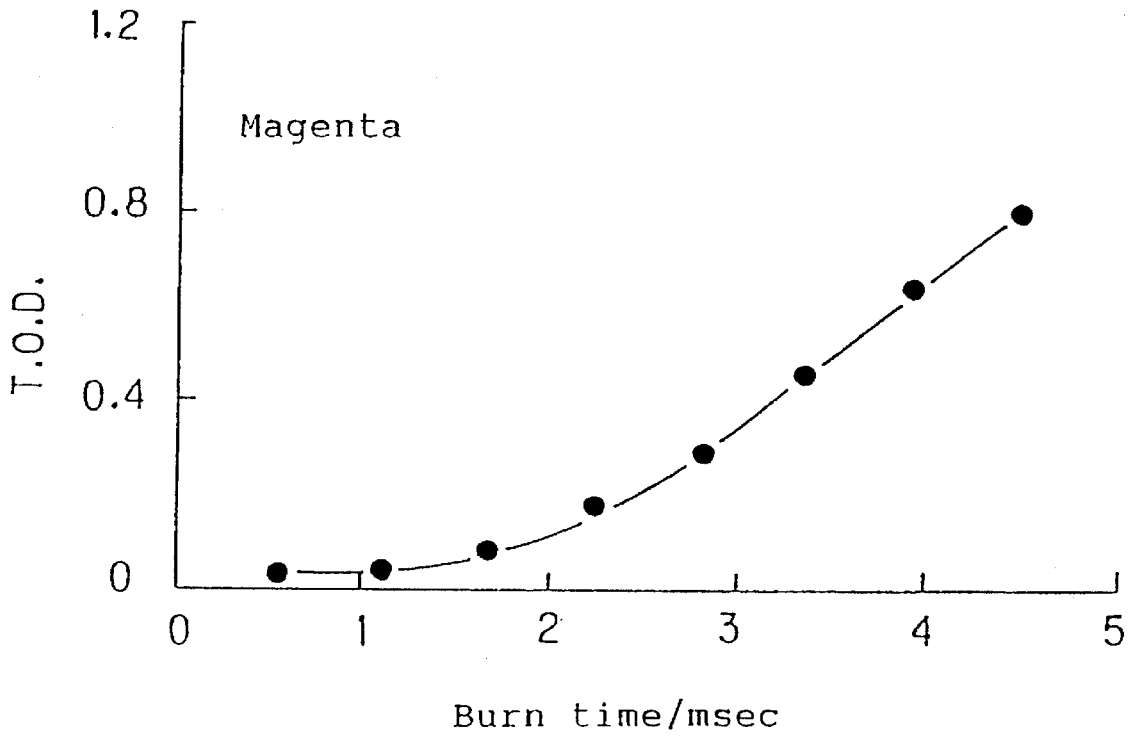
FIG. 19 shows a relation between burn time and the image density obtained in Example 9.

When type 5 porous polypropylene films (#770-3S, from 3M, U.S.A.) were evaluated in the same manner as that in Example 5, optical densities of the printed images on a receptor layer showed gradation, and were in linear relation to the applied thermal energy. The result is shown in FIG. 19.

EXAMPLE 10

Figure 20:
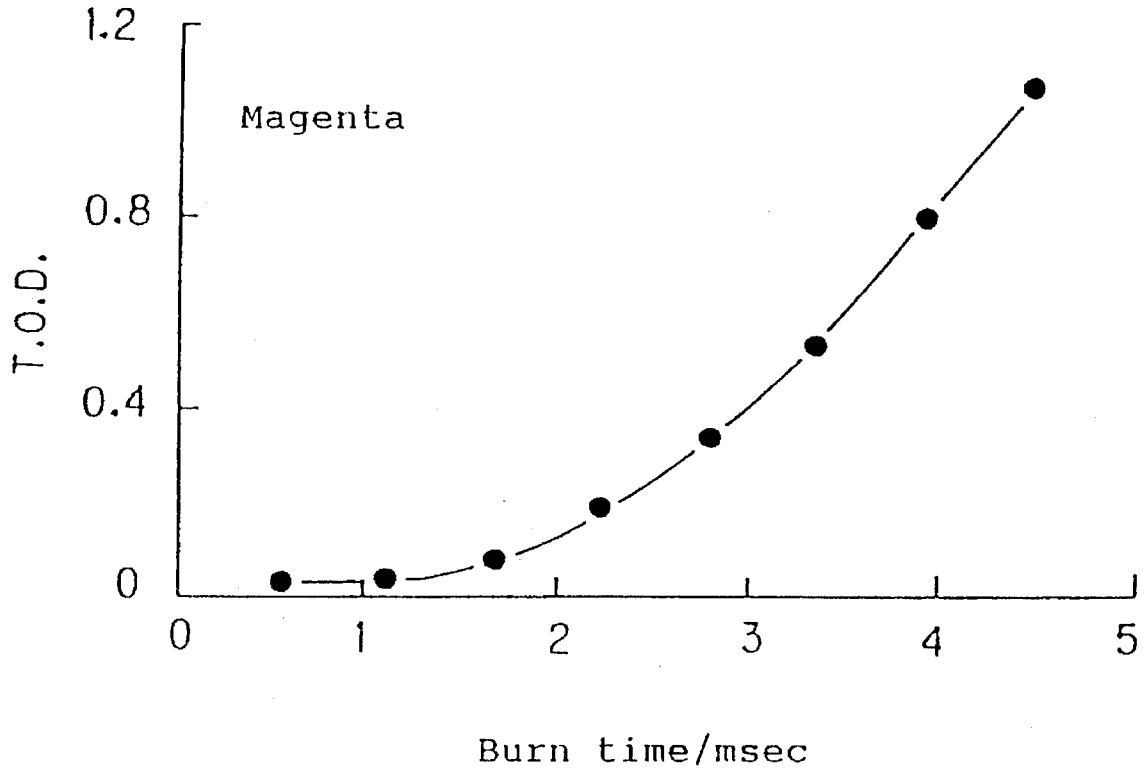
FIG. 20 shows a relation between burn time and the image density obtained in Example 10.

When type 5 porous polypropylene films (#770-4S, from 3M, U.S.A.) were evaluated in the same manner as that in Example 5, optical densities of the printed images on a receptor layer showed gradation, and were in linear relation to the applied thermal energy. The result is shown in FIG. 20.

EXAMPLE 11

Figure 21:
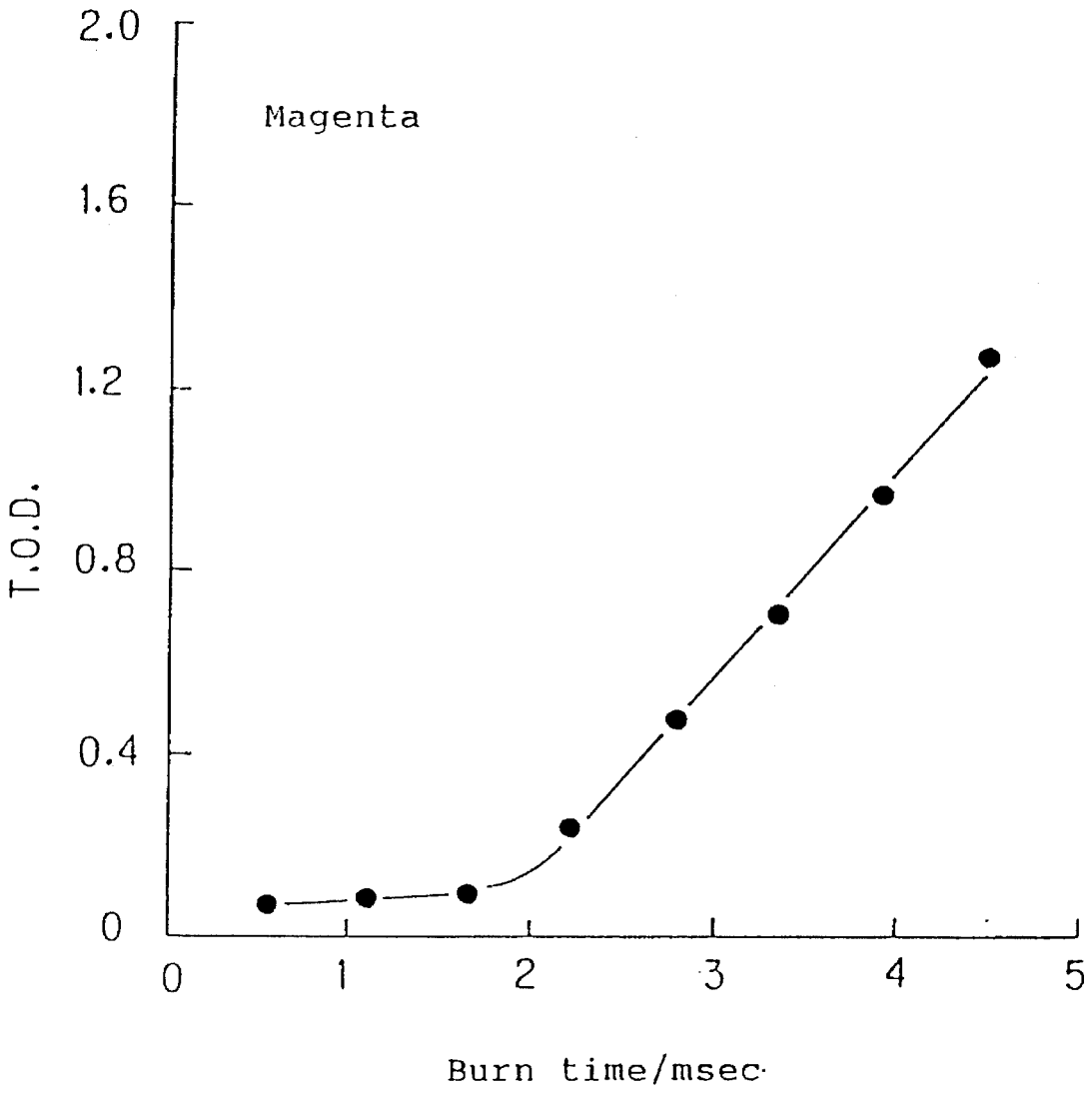
FIG. 21 shows a relation between burn time and the image density obtained in Example 11.

When type 5 porous polypropylene films (#770-6S, from 3M, U.S.A.) were evaluated in the same manner as that in Example 5, optical densities of the printed images on a receptor layer showed gradation, and were in linear relation to the applied thermal energy. The results are shown in FIG. 21.

EXAMPLE 12

Figure 22:
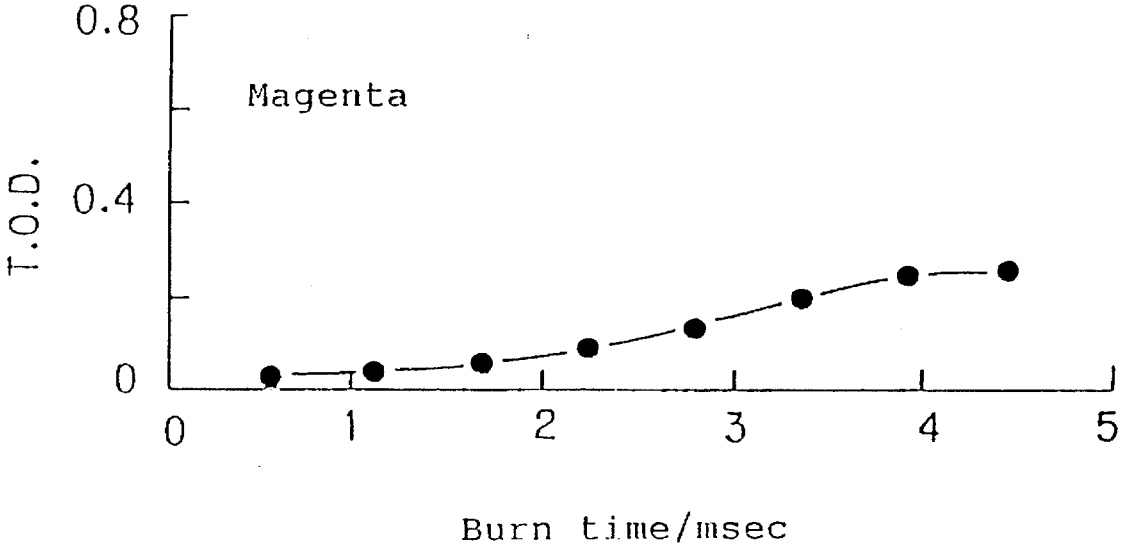
FIG. 22 shows a relation between burn time and the image density obtained in Example 12.

Type 7 magenta dye-coated thin papers were evaluated in the same manner as that in Example 5. The results are shown in FIG. 22, demonstrating that a film not entailing deformation, shrinkage, or melting of minute pores due to the heat application can also be used as a donor containing no binder.

As described previously, all of the donor films of this invention showed a good proportional relation between the burn time and the image density, and also showed very good gradation.

What is claimed is:

1. A film for producing a dye diffusion thermal transfer image comprising diffusible dyes physically located in pores of a porous film having a Gurley value between 20 and 400 seconds per 50 cubic centimeters of air, said porous film containing no binder.

2. A film according to claim 1, wherein said porous film is a porous polyethylene film or a porous polypropylene film.

3. A film according to claim 1 or 2, wherein a protective layer is applied or laminated on one surface of said porous film.

4. A process for the thermal diffusion transfer of a color image, comprising placing a color thermal diffusion dye donor sheet in intimate association with a receptor sheet, and heating said donor sheet in a desired pattern at a sufficient temperature and pressure to transfer dye from the donor sheet to the receptor sheet, said process being characterized in that said donor sheet comprises a porous polymeric material having a Gurley value between 10 and 400 seconds per 50 cubic centimeters of air and having a thermally diffusible dye located within pores of said porous material, said donor sheet containing no binder.

5. A process according to claim 4, wherein said porous film is a porous polyethylene film or a porous polypropylene film.

6. A process according to claim 4 or 5, wherein a protective layer is applied or laminated on one surface of said porous film.

7. A film for producing a dye diffusion thermal transfer image consisting essentially of diffusible dyes physically located in pores of a porous film having a Gurley value between 10 and 400 seconds per 50 cubic centimeters of air, said porous film containing no binder.

8. The film of claim 7 wherein said porous film is a porous polyethylene film or a porous polypropylene film.

9. The film of claim 7 wherein said Gurley value is between 19 and 400 seconds per 50 cubic centimeters of air.

10. A process for the thermal diffusion transfer of a color image, comprising placing a color thermal diffusion dye donor sheet in intimate association with a receptor sheet, and heating said donor sheet in a desired pattern at a sufficient temperature to transfer dye from the donor sheet to the receptor sheet, said process being characterized in that said donor sheet consists essentially of a porous polymeric material having a Gurley value between 10 and 400 seconds per 50 cubic centimeters of air and having a thermally diffusible dye located within pores of said porous material, said donor sheet containing no binder.

* * * * *